US007717320B2

(12) United States Patent
Quaintance

(10) Patent No.: US 7,717,320 B2
(45) **Date of Patent: *May 18, 2010**

(54) SELF LOCKING FEATURE FOR CONTAINERS

(75) Inventor: Benjamin Quaintance, Germantown, TN (US)

(73) Assignee: International Paper Company, Memphis, TN (US)

( * ) Notice: Subject to any disclaimer, the term of this patent is extended or adjusted under 35 U.S.C. 154(b) by 475 days.

This patent is subject to a terminal disclaimer.

(21) Appl. No.: 10/208,706

(22) Filed: Jul. 25, 2002

(65) Prior Publication Data

US 2003/0047592 A1 Mar. 13, 2003

Related U.S. Application Data

(60) Provisional application No. 60/307,681, filed on Jul. 25, 2001.

(51) Int. Cl.
*B65D 5/20* (2006.01)
*B65D 21/032* (2006.01)

(52) U.S. Cl. ..... 229/117.35; 229/108; 229/110; 229/109; 229/918; 229/165; 229/193

(58) Field of Classification Search ..... 229/117.35, 229/109, 108, 110, 918, 165, 193; 220/495.11
See application file for complete search history.

(56) References Cited

U.S. PATENT DOCUMENTS 3,547,337 A * 12/1970 Pisarczuk ..... 229/117.17
3,696,989 A * 10/1972 Kochevar ..... 229/177
3,883,067 A * 5/1975 McGlynn et al. ..... 229/177
3,918,630 A 11/1975 Meyers
4,600,142 A * 7/1986 Quaintance ..... 229/143
4,676,429 A * 6/1987 Crowe et al. ..... 229/109
5,392,985 A * 2/1995 Smith et al. ..... 229/125
D384,885 S * 10/1997 Halsell, II ..... D9/432
5,752,648 A 5/1998 Quaintance
6,651,873 B2 * 11/2003 Quaintance ..... 229/109

* cited by examiner

*Primary Examiner*—Tri M Mai
(74) *Attorney, Agent, or Firm*—Dennis Lambert; Daniel Stelter; Thomas W. Ryan, III

(57) ABSTRACT

A container made from corrugated paperboard has a bottom wall, opposite side and end walls, and a self locking arrangement on the end walls holding the container in erected condition. The self locking arrangement includes first and second end panels on opposite ends of the side walls, and a third end panel on opposite ends of the bottom wall. The end panels form the end walls of the container. The first and second end panels have at least one notch formed in an upper edge, and a roll over flap is foldably joined by at least one web to an upper edge of each of the third end panels and is folded inwardly and downwardly over the upper edges of the first and second end panels into a locked position to hold the end panels and thus the container in erected condition. In the locked position, the web is engaged in the notch. In particular, the web has a thickness less than the thickness of an end panel, so that it fits deeply into the notch, producing a tight fit and reliable interlocking of the components of the self locking arrangement.

8 Claims, 9 Drawing Sheets

SELF LOCKING FEATURE FOR CONTAINERS

This application claims the benefit of U.S. Provisional Application No. 60/307,681, filed Jul. 25, 2001, entitled "Poultry Pack".

BACKGROUND OF THE INVENTION

1. Field of the Invention

This invention relates to packaging. More specifically, the invention relates to a multi-sided container or box made of corrugated paperboard. In particular, the invention relates to a corrugated paperboard tray for containing poultry products, wherein the tray is configured for manual set up and has an improved self locking feature for retaining the walls of the tray in erected position.

2. Prior Art

Various styles of containers, including paperboard boxes, are known in the prior art for containing a variety of products. Cut poultry pieces, for example, are frequently packed in a paperboard container, and sometimes the poultry pieces are packed with ice. These containers are generally referred to as poultry trays, and are usually made from a unitary blank of corrugated paperboard, which may be treated on one or both sides with wax or other material to impart rigidity and resistance to water degradation.

Conventional paperboard containers are configured for either machine set up or manual set up, and generally are either rectangular or octagonal in plan view, with four sides or eight sides, respectively. An example of a prior art eight sided container is disclosed in applicant's prior U.S. Pat. No. 5,752,648. The embodiment shown in FIGS. 1-3 of that patent is configured for manual set up, and has three overlapping end panels 18, 24 and 24, with notches 30 formed in the top edges of the two end panels 24, and a roll over flap 34 foldably joined to the top edge of end panel 18 by short narrow webs formed between transverse cuts or relief slits 37 extending in spaced relationship transversely across cut lines 36 and 38, and interrupting the cut lines. Pairs of short cuts or slits 39 are formed in the webs parallel to the cut lines 36 and 38, but spaced from one another on opposite sides of the cut lines a distance approximately equal to the combined thicknesses of the three overlapped end panels. The slits 39 promote bending or folding of the webs along fold lines extending through the slits.

To erect the container, the two end panels 24 are folded inwardly into overlapping registry with one another, and the end panel 18 is then folded into overlapping relationship with panels 24. The roll over flap 34 is then folded inwardly and downwardly over the upper edges of the panels 24, causing the webs to drop into notches 30, and the upwardly extending portions of panels 24 on opposite sides of the notches to project upwardly through the cuts formed by the cut lines 36 and 38. The relationship of the relief slits 37 and cut lines 36 and 38 causes a "heel" to be formed on the edge of the roll over flap, and this heel produces an over-center effect when the roll over flap is folded over the panels 24. The heel engages against the inner surface of the innermost end panel 24 to keep the roll over flap in its folded position, and thereby maintains the container in erected condition.

While the arrangement disclosed in U.S. Pat. No. 5,752,648 provides a simple and effective self locking system for holding the container in its erected condition, the thickness of the material of the webs causes them to take a slightly "rounded over" shape as they are pulled down into the notches 30, and they tend to exert a pull on the roll over flap in a direction to disengage it. Additionally, in order to insure that the webs and related components can be operatively engaged with one another, specific dimensional relationships are maintained between the distance from the bottoms of the notches to the bottom of their associated panels 24, and the distance which the relief slits 37 extend above the cut lines 36 and 38, i.e., the length of the relief slits is slightly exaggerated, contributing to a "loose" fit between the components of the self locking arrangement.

Accordingly, there is need for a self locking arrangement that provides a tight, secure fit between components, insuring that a container incorporating the arrangement reliably remains in its erected condition.

SUMMARY OF THE INVENTION

The container of the invention has a self locking arrangement that provides a tight, secure fit between components, insuring that a container incorporating the arrangement reliably remains in its erected condition. The self locking arrangement is similar to that used in U.S. Pat. No. 5,752,648, but is modified to achieve a tighter fit between components of the self locking arrangement and provide a more reliable interlocking of the components.

More specifically, the container of the invention has a bottom wall, opposite side walls, and opposite end walls, with means on the end walls that interlock to hold the container in its erected condition. The container is made from a unitary corrugated paperboard blank having a bottom panel that forms the bottom wall, opposite side wall panels foldably joined to opposite sides of the bottom panel and that form the side walls, and end panels extending from opposite ends of the bottom panel and side wall panels, respectively, at least some of the end panels overlapping to form the end walls in accordance with the invention. At least one notch is formed on an upper edge of at least one of the end panels, and a roll over flap is formed on an upper edge of another end panel, in positions to interlock with one another when the end panels are folded into operative relationship with one another to form an erected container.

In particular, the self locking structure of the present invention has a plurality of notches formed in the edge of at least one end panel, defining at least one tab projecting upwardly from the edge of the panel, and the roll over flap is foldably joined to its associated end panel by webs formed between a cut line that lies parallel to the fold for the roll over flap, and relief slits that extend transversely across the cut line. The webs are adapted to lie in the notches, with said at least one tab projecting into a slot formed by the cut line when the roll over flap is folded inwardly and downwardly over the end panels.

In accordance with the present invention, the webs are at least partially crushed on the side thereof that faces downwardly in the notches so that they lie substantially flat in the notches. In addition, the dimensional relationships of the self locking arrangement are made tighter to effect a tighter fit between components, producing a more reliable interlock. Specifically, the distance from the bottom of the notches to the bottom of their associated panels is made smaller than in a tray having a conventional self locking arrangement, and the length of the relief slits is also made smaller.

The invention is a simple, economical and effective way to reliably interlock components of a self locking arrangement in a container constructed for manual set up. It adds no cost to the container.

BRIEF DESCRIPTION OF THE DRAWINGS

The invention is described in greater detail hereinafter with reference to the drawings, wherein like reference characters designate like parts throughout the several views, and wherein.

DETAILED DESCRIPTION OF THE PREFERRED EMBODIMENTS

Figure 1:
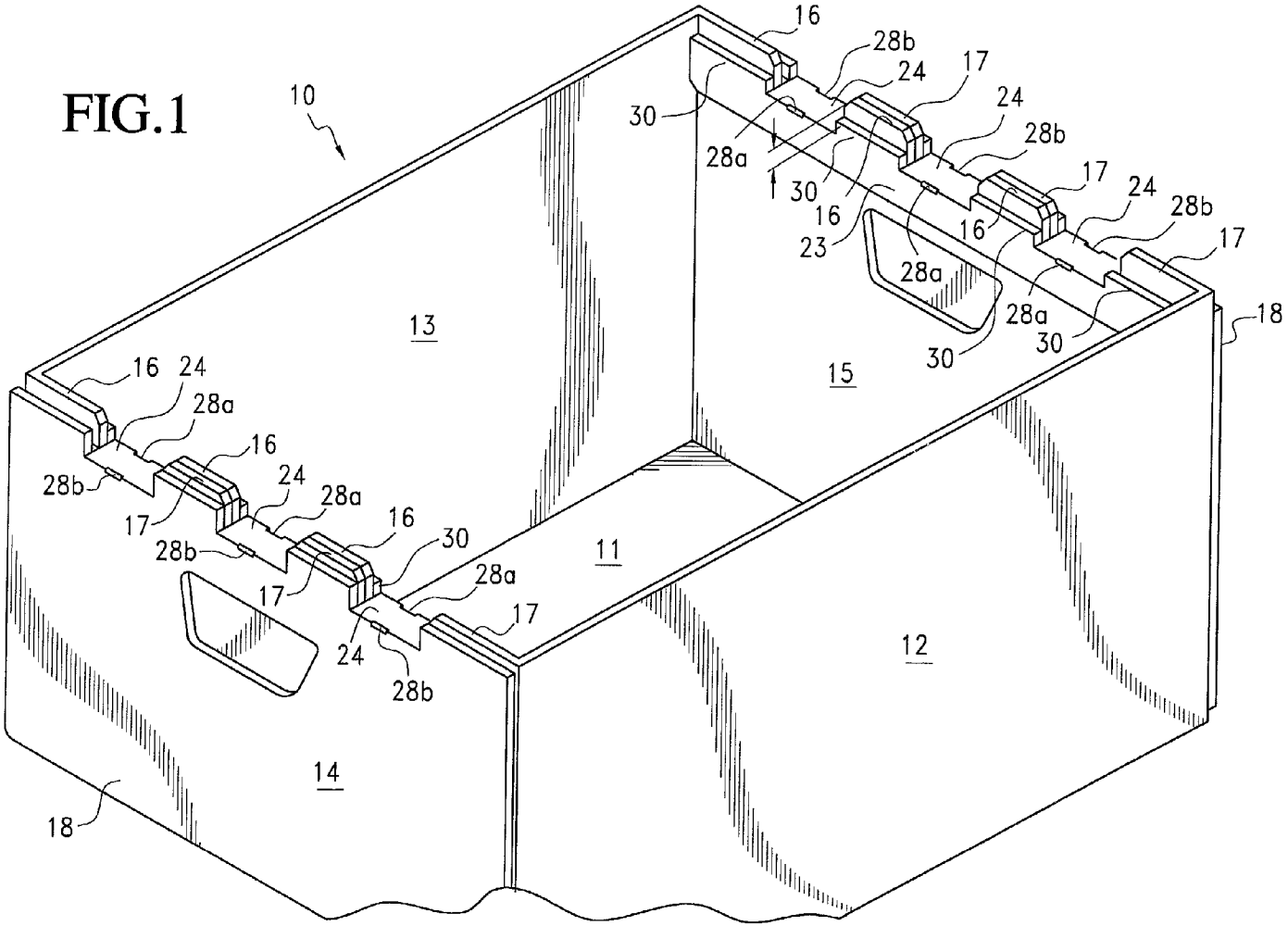
FIG. 1 is a top perspective view of a four sided rectangular container incorporating the self locking means of the present invention.
Figure 2:
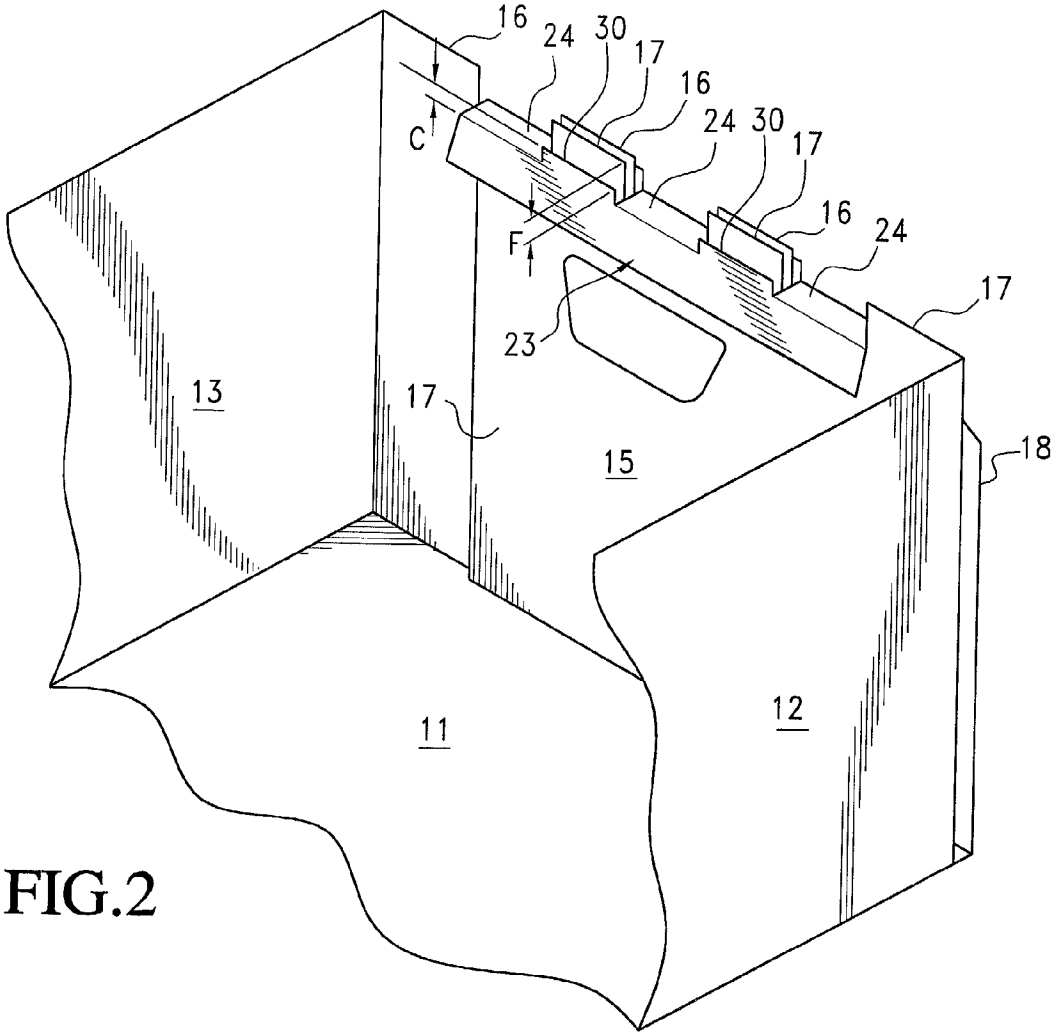
FIG. 2 is a somewhat schematic fragmentary top perspective view showing in single line drawing the self locking means at one end of a container similar to that shown in FIG. 1.
Figure 3:
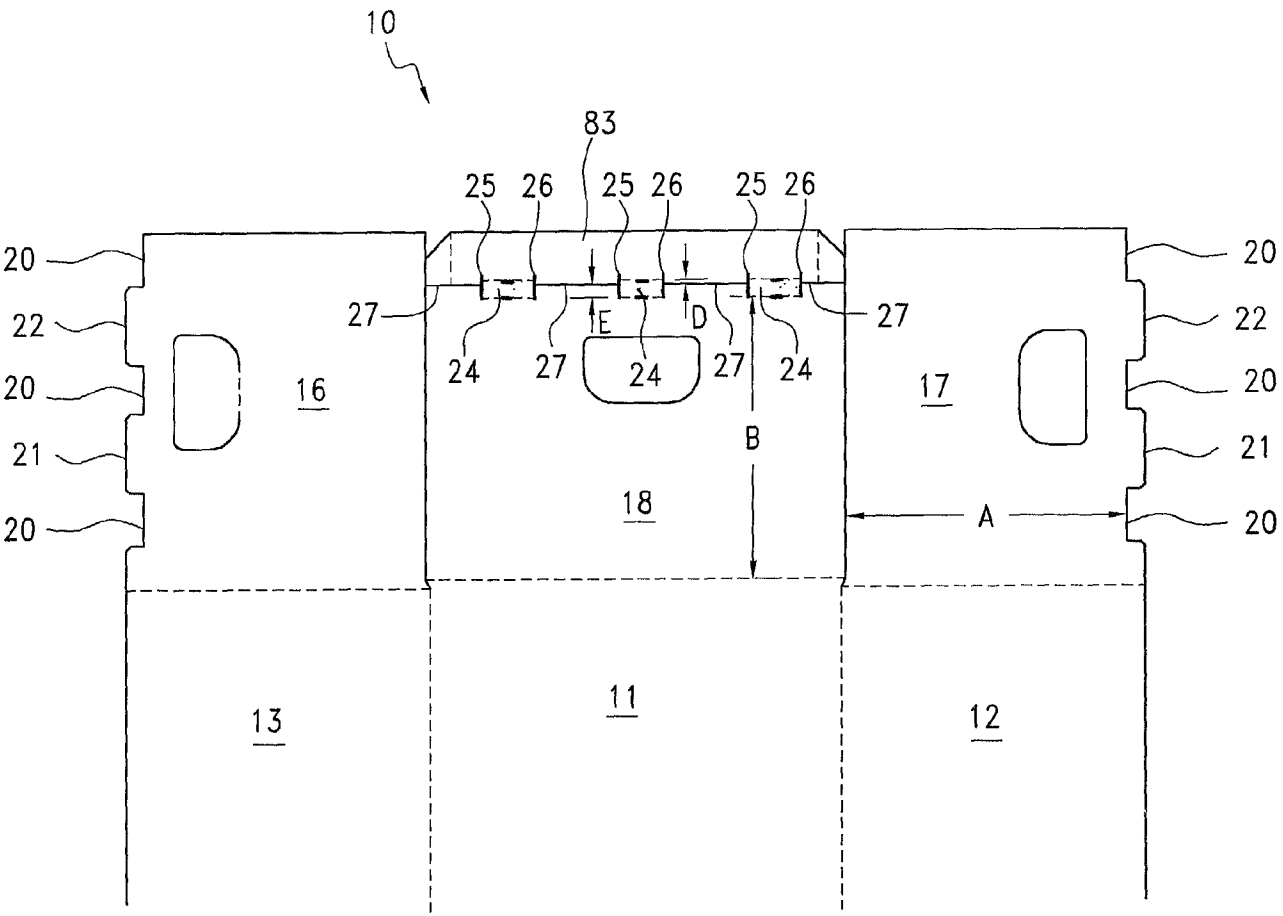
FIG. 3 is an enlarged fragmentary plan view of one end of a blank used in constructing the container of FIG. 1.

A rectangular or four sided container incorporating the self locking means of the invention is depicted at 10 in FIGS. 1-3. The container 10 comprises a bottom wall 11, opposite parallel side walls 12 and 13, and opposite parallel end walls 14 and 15. Each end wall comprises two end panels 16 and 17 foldably joined to opposite ends of the side walls, and an end panel 18 foldably joined to the end of the bottom wall.

A plurality of notches 20 are formed in each end panel 16 and 17 along an outer edge, which becomes the upper edge when the container is set up, forming a pair of upwardly projecting tabs 21 and 22.

A roll over flap 23 is joined to the outer, or upper, edge of end panel 18 by a plurality of webs 24 defined by cuts or relief slits 25 and 26 made transversely across cut line 27, and interrupting the cut line, which extends completely across the width of panel 18 except at the webs 24. Short fold promoting slits 28*a* and 28*b* are made parallel to the cut line 27 on opposite sides thereof in locations to define the length of the webs when the roll over flap is folded into its operative, locked position. In other words, the slits 28*a* and 28*b* initiate folding at opposite ends of the web along fold lines extending through the slits. The length of the webs, as defined by the spacing between the slits, and thus between the fold lines extending through them, is substantially the same as the combined thicknesses of the total number of overlapping end panels, minus the thickness of that end panel to which the roll over flap is attached.

Figure 7:
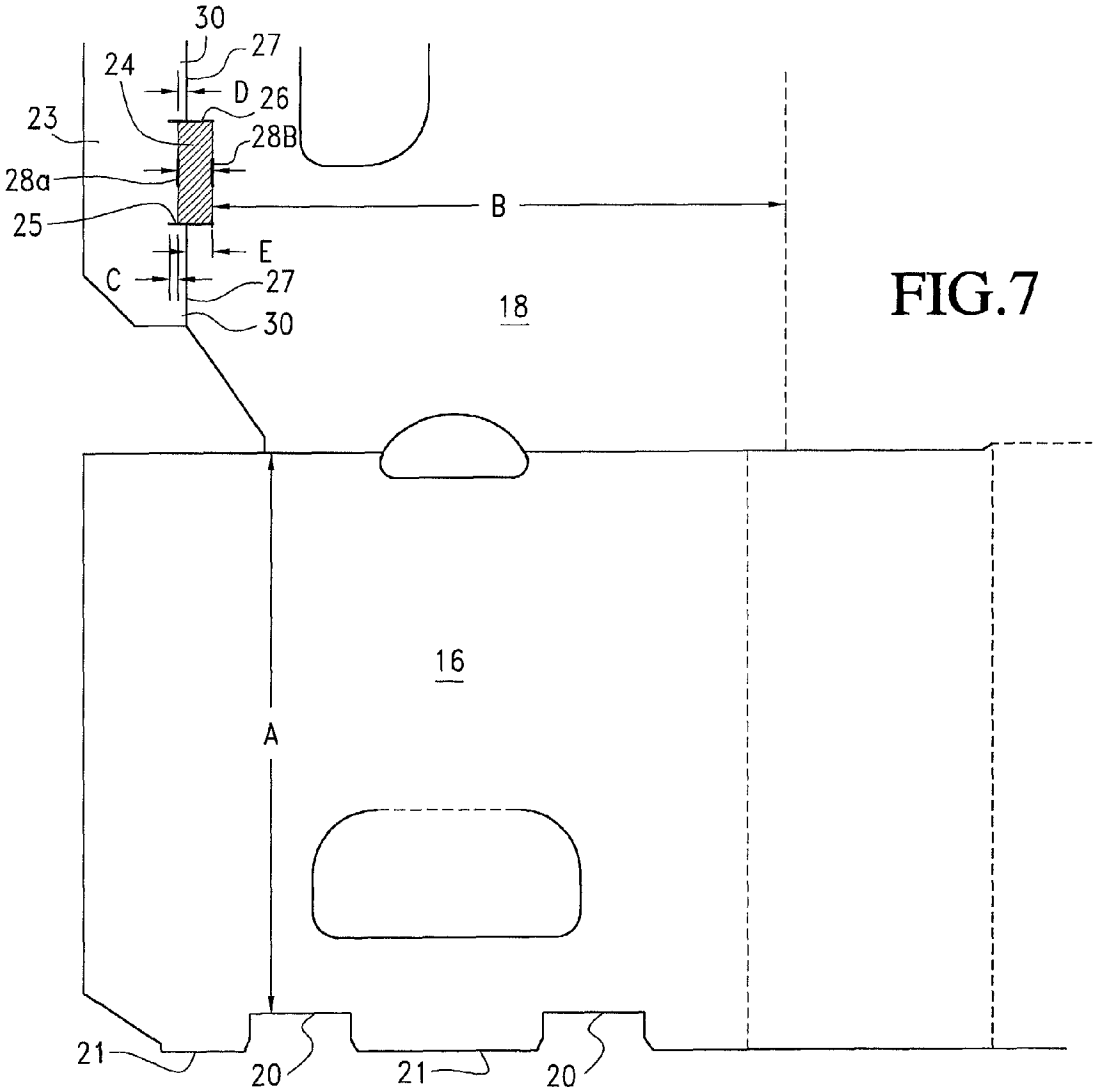
FIG. 7 is a greatly enlarged fragmentary plan view of a portion of the blank of FIG. 6, showing details of construction.

As indicated by the shading in FIGS. 3 and 7 (it should be noted that while FIG. 7 is used to show the details of construction of the self locking arrangement, and reference characters applicable to FIGS. 1-3 are used, FIG. 7 actually shows a portion of a blank designed for making the eight sided container of FIG. 5), the web 24 is crushed in the area between the cuts 25, 26 and fold promoting slits 28. The crush is made on the side of the web that faces inwardly of the container when the container is set up. Crushing of the web enables the web to extend more deeply into the notches, and provides a sharper fold along the fold lines promoted by the slits 28*a* and 28*b*. It also enables other dimensions of the container to be tightened up, as described more fully below, developing a tighter and more reliable self locking arrangement.

To erect the container, the side walls 12 and 13 are folded upwardly, and the end panels 16 and 17 then folded inwardly into overlapping relationship with one another. As seen in the drawings, panel 17 is folded inwardly first, although the sequence of folding the two end panels is not essential. As folded, the notches 20 and tabs 21 and 22 on the two end panels are in registry with one another. The end panel 18 is then folded upwardly over the panels 16 and 17, and roll over flap 23 is folded inwardly and downwardly over the upper edge of the end panels, causing the webs 24 to drop into the notches and the tabs 21 and 22 to project upwardly through the gap formed by the cut line 27. Because of the spacing of the cuts 25, 26, 27 and 28*a* and 28*b*, a "heel" 30 is formed on the roll over panel in the areas on opposite sides of the webs, and this heel engages against the inner surface of end panel 17, holding the roll over flap in its downwardly folded and locked position inside the panel 17.

The dimensional relationships of the self locking structure can best be seen with particular reference to FIGS. 2, 3 and 7. The spacing "A" between the bottom of the notches 20 and the bottom edge of the associated end panel 16 or 17 is increased slightly over the spacing in the prior self locking arrangement shown in U.S. Pat. No. 5,752,648, and the spacing "B" between the bottom edge of end panel 18 and the closest slit 28*b* is reduced slightly from the spacing in the prior self locking arrangement. The spacing between the slits 28*a* and 28*b*, as noted previously, is selected to be substantially the same as the combined width of the total number of overlapping end panels minus the thickness of that end panel to which the roll over flap is attached. It will be noted that the slits 25 and 26 extend slightly beyond slit 28*a* a distance "C", defining relief slits for the folded roll over flap. Slit 28*a* is spaced from cut line 27 a distance "D" approximately equal to a thickness of one of the end panels, and slit 28*b* is spaced on the opposite side a distance "E" approximately equal to the combined thickness of the total number of overlapping end panels, minus the thickness of one panel.

When the roll over flap 23 is folded downwardly alongside panel 17, the heels 30 extend upwardly and above the fold line that extends through slits 28*b*, preventing the flap from disengaging from its locked position. To function properly, the upper edge of the heel, when the roll over flap is in its operative folded position, is spaced below the upper edge of the tabs a distance "F" equal to at least the combined thickness of two panels.

Figure 4:
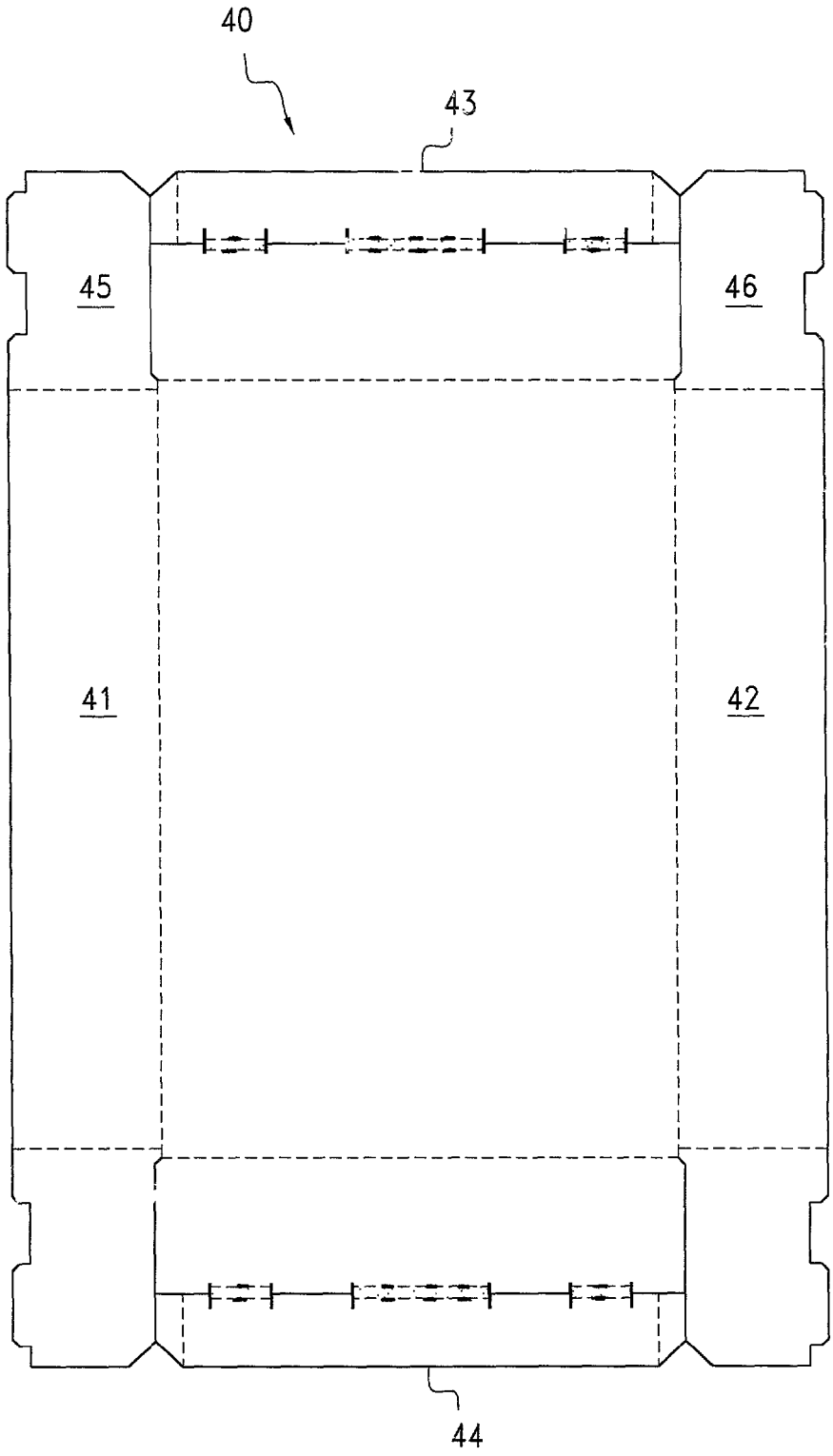
FIG. 4 is an enlarged plan view of a blank that may be used in constructing a four sided rectangular container of shallow depth.

A blank for forming a first variation of the invention is indicated generally at 40 in FIG. 4. This form of the invention incorporates a self locking arrangement that embodies the same principles and dimensional relationships as that previously described, but differs in that the side walls 41 and 42 and end walls 43 and 44 are not as deep, producing a more shallow container. Additionally, the end panels 45 and 46 do not overlap each other in the erected container.

Figure 6:
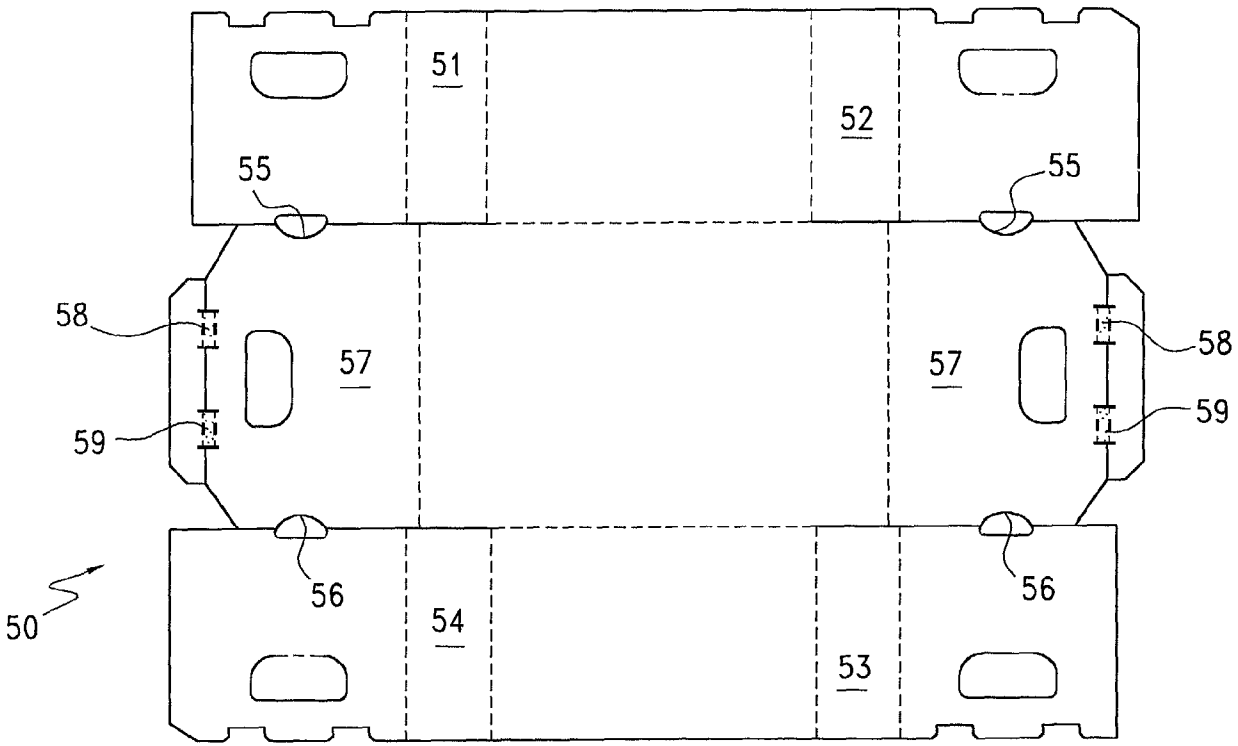
FIG. 6 is a plan view of a blank for making the eight sided container of FIG. 5.
Figure 5:
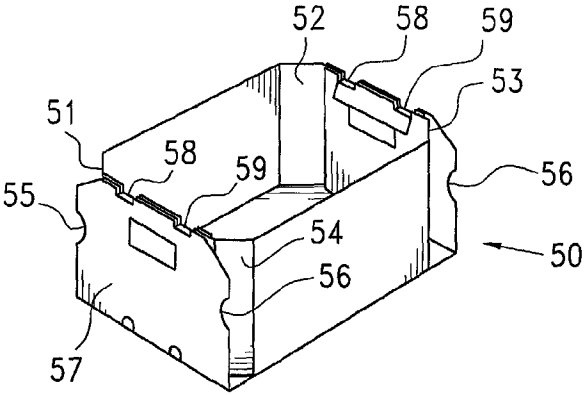
FIG. 5 is a top perspective view of an eight sided octagonal container incorporating the self locking means of the present invention.

FIGS. 5, 6 and 7 illustrate the invention incorporated in an eight sided container 50. The principles of operation and dimensional relationships of the self locking arrangement are the same as previously described, but the container 50 has mitered corners defined by diagonal corner panels 51-54. In addition, notches 55 and 56 are formed in opposite side edges of end panels 57, and in the erected container these notches form bag cuff grabs which engage and hold the rolled over upper end of a bag placed in the container to hold the bag in position while product is placed in the bag. Further, only two webs 58 and 59 connect the roll over flap to the end panel, rather than the three webs in the previous embodiment.

Figure 9:
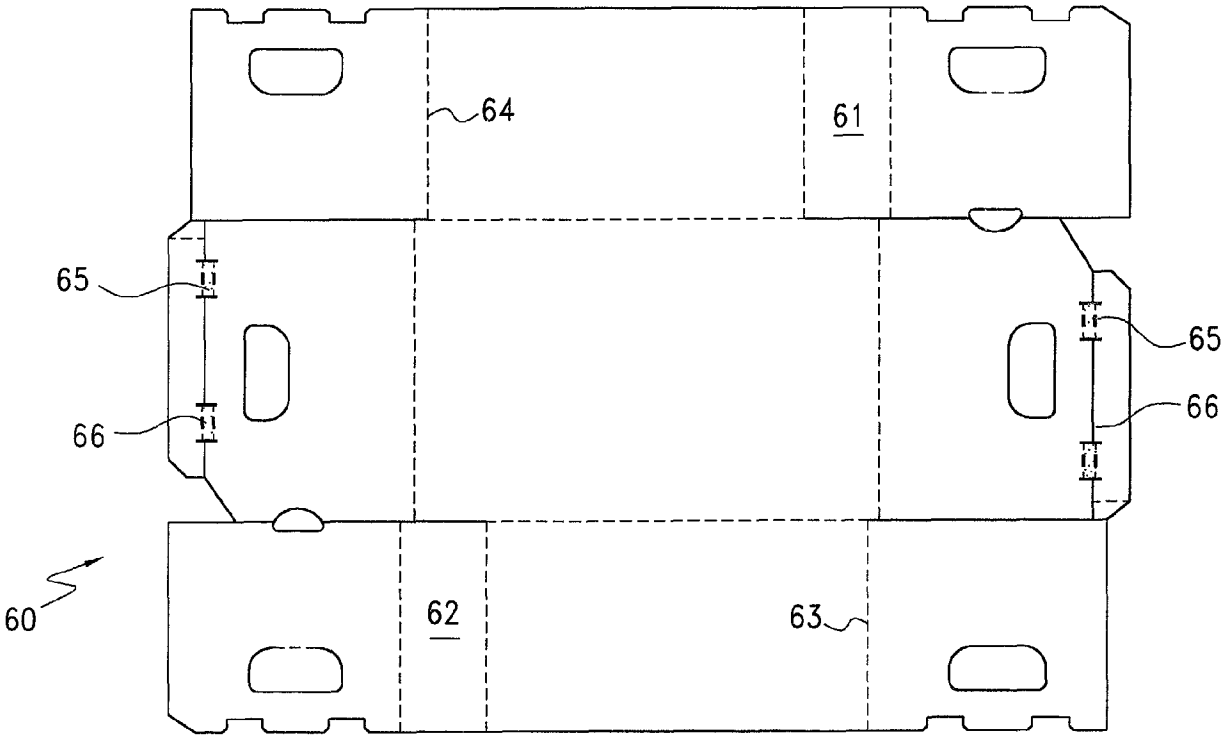
FIG. 9 is a plan view of a blank for making the six sided container of FIG. 8.
Figure 8:
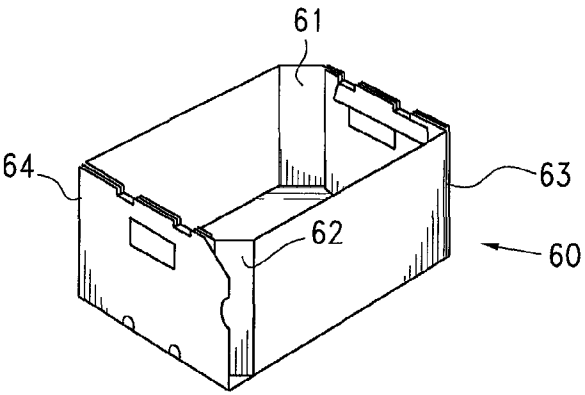
FIG. 8 is a top perspective view of a hexagonal or six sided container incorporating the self locking means of the invention.

A six sided container incorporating the self locking arrangement of the invention is shown at 60 in FIGS. 8 and 9. This form of the invention also incorporates the same principles of operation and dimensional relationships as that previously described, but has two diagonally opposed mitered corners 61 and 62 and two square corners 63 and 64. It also has only two webs 65 and 66.

Figure 11:
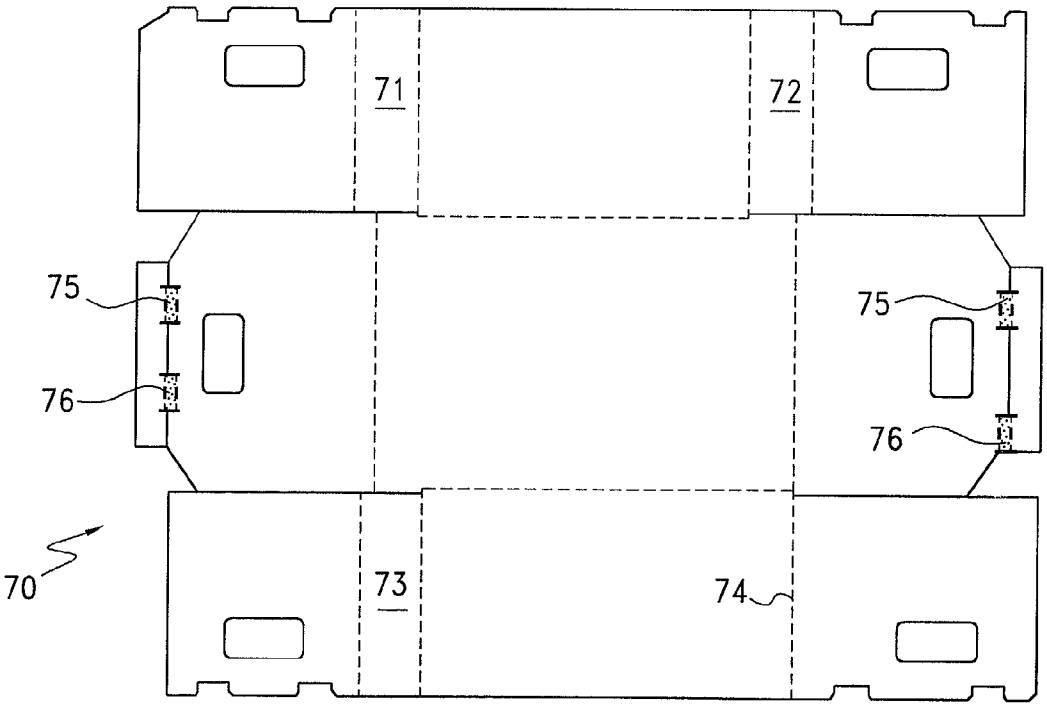
FIG. 11 is a plan view of a blank used for making the seven sided container of FIG. 10.
Figure 10:
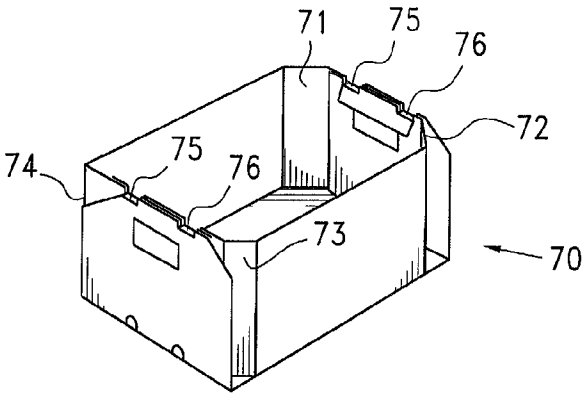
FIG. 10 is a top perspective view of a seven sided container incorporating the self locking means of the present invention.

A seven sided container incorporating the self locking arrangement of the invention is indicated generally at 70 in FIGS. 10 and 11. This form of the invention also incorporates the same principles of operation and dimensional relationships as that previously described, but has three diagonally opposed mitered corners 71, 72 and 73 and one square corner 74. It also has only two webs 75 and 76.

Figure 13:
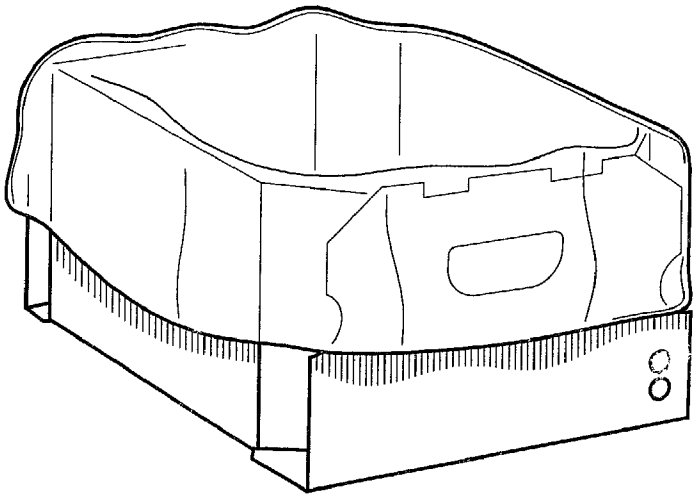
FIG. 13 is a top perspective view of a container incorporating the self locking means of the present invention, and also incorporating a bag cuff grab as described more fully in applicant's copending application filed on even date herewith, and showing a bag in place and rolled over to form a cuff that is engaged in the notches forming the bag cuff grab.
Figure 12:
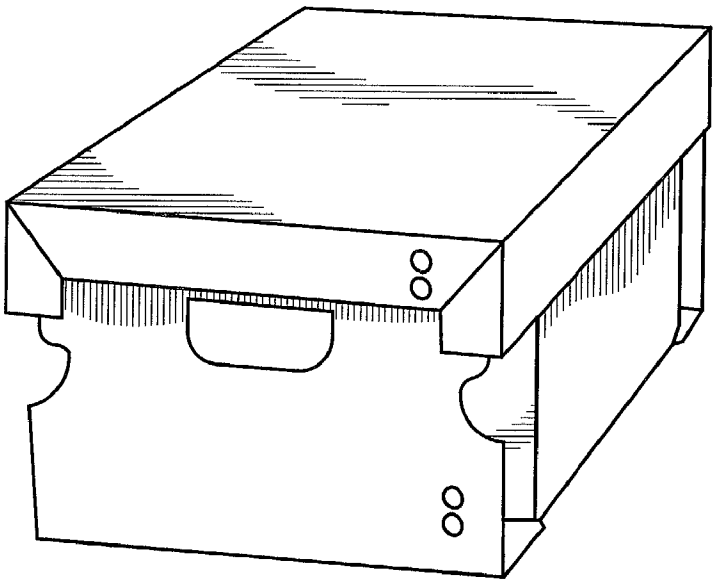
FIG. 12 is a top perspective view of a container of the invention, showing a cover in place on the container.

As shown in FIG. 12, a cover is typically placed on the container, and a plastic bag is also sometimes inserted into the container to receive the product (see FIG. 13, for example).

Although particular embodiments of the invention are illustrated and described in detail herein, it is to be understood that various changes and modifications may be made to the invention without departing from the spirit and intent of the invention as defined by the scope of the appended claims.

What is claimed is:

1. A paperboard container, wherein the container has a bottom wall, six sides including opposite side walls and opposite end walls, two mitered corners and a self-locking arrangement on the end walls for holding the container in an erected condition, wherein:

said opposite side walls each have opposite ends and a free upper edge, and an end hap panel on each of said opposite ends, said end flap panels each having a free upper edge substantially coplanar with the free upper edge of a respective said side wall, and at least one notch formed in the free upper edge of each said end flap panel;

an end wall panel is on each of opposite ends of the bottom wall, said end wall panel and said end flap panels at respective opposite ends of the container folded into overlapping relationship with one another and forming the opposite end walls of the container; and a roll-over flap is foldably joined by at least one web to said upper edge of each of the end wall panels, said roll-over flap being folded inwardly and downwardly over the free upper edges of the respective end flap panels at opposite ends of the container, said at least one web on the upper edge of each said end wall panel having a width less than the width of an associated said end wall panel, and said at least one web on each of the end wall panels being engaged in said at least one notch in the free upper edge of an associated said end flap panel; and bag cuff grab means on each of two diagonally opposite mitered corners.

2. A container as claimed in claim 1 wherein; the end panels overlap one another.

3. A container as claimed in claim 1 wherein, there are a plurality of webs connecting the roll over flap to each of the end wall panels.

4. A container as claimed in claim 1, wherein, the web is crushed to reduce its thickness.

5. A container as claimed in claim 1, wherein, the container has seven sides, including said side and end walls, and three mitered corners.

6. A container as claimed in claim 5, wherein, bag cuff grab means is on at least one mitered corner.

7. A container as claimed in claim 1, wherein, the container has eight sides, with two opposite parallel side walls, two opposite parallel end walls, and four mitered corners.

8. A container as claimed in claim 1 wherein, there are a plurality of webs connecting the roll over flap to the third end panel.

* * * * *

UNITED STATES PATENT AND TRADEMARK OFFICE

CERTIFICATE OF CORRECTION

PATENT NO. : 7,717,320 B2
APPLICATION NO. : 10/208706
DATED : July 25, 2002
INVENTOR(S) : Benjamin W. Quaintance It is certified that error appears in the above-identified patent and that said Letters Patent is hereby corrected as shown below:

Column 6 Claim 1, lines 7-12 should be corrected as follows:

said opposite side walls each have opposite ends and a free upper edge, and an end flap panel on each of said opposite ends, said end flap panels each having a free upper edge substantially coplanar with the free upper edge of a respective said side wall, and at least one notch formed in the free upper edge of each said end flap panel;

Signed and Sealed this

Twenty-ninth Day of June, 2010

David J. Kappos

David J. Kappos
*Director of the United States Patent and Trademark Office*